US009629512B2

(12) United States Patent
Gould

(10) Patent No.: US 9,629,512 B2
(45) Date of Patent: Apr. 25, 2017

(54) SWITCHING MECHANISM FOR A VACUUM CLEANER HAVING COUPLING MECHANISM FOR SWITCHING A VACUUM SWITCH AND AN AGITATOR SWITCH

(71) Applicant: Dyson Technology Limited, Wiltshire (GB)

(72) Inventor: Oliver James Gould, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 591 days.

(21) Appl. No.: 14/062,564

(22) Filed: Oct. 24, 2013

(65) Prior Publication Data

US 2014/0115818 A1 May 1, 2014

(30) Foreign Application Priority Data

Oct. 26, 2012 (GB) ..... 1219283.7

(51) Int. Cl.
*A47L 9/28* (2006.01)
*H01H 9/26* (2006.01)
*H01H 13/56* (2006.01)

(52) U.S. Cl.
CPC ..... *A47L 9/2857* (2013.01); *A47L 9/2842* (2013.01); *A47L 9/2847* (2013.01); *H01H 9/26* (2013.01); *H01H 13/56* (2013.01)

(58) Field of Classification Search
CPC ..... H01H 9/26; H01H 9/24; A47L 9/2894; A47L 9/2889; A47L 9/2857;
(Continued)

(56) References Cited

U.S. PATENT DOCUMENTS 3,319,282 A * 5/1967 Macfarland ..... A47L 9/2857 15/319
3,411,170 A * 11/1968 Kingsley ..... A47L 11/201 15/50.1

(Continued)

FOREIGN PATENT DOCUMENTS

GB 2 422 093 7/2006

OTHER PUBLICATIONS

Search Report dated Feb. 26, 2013, directed to GB Application No. 1219283.7; 1 page.

*Primary Examiner* — Joseph J Hail
*Assistant Examiner* — Arman Milanian
(74) *Attorney, Agent, or Firm* — Morrison & Foerster LLP

(57) ABSTRACT

A switching mechanism for a vacuum cleaner having a vacuum generator and an agitator, comprising a vacuum generator switch, an agitator switch, and a coupler for coupling the agitator switch with the vacuum generator switch such that switching of the vacuum generator switch switches the agitator switch. The switching mechanism is configured such that, switching of at least one of the agitator switch and the vacuum generator switch uncouples the agitator switch from the vacuum generator switch. The switching mechanism is further configured such that, when the vacuum generator switch and the agitator switch are uncoupled from each other and the agitator switch is in its open state, switching of the vacuum generator switch from its closed state to its open state couples the agitator switch with the vacuum generator switch.

16 Claims, 8 Drawing Sheets

A

(58) Field of Classification Search
CPC .. A47L 9/2847; A47L 9/2831; A47L 9/04111; A47L 5/30; A47L 11/4011; A47L 11/4008
USPC ..... 15/363; 200/5 B, 1 B, 18, 50.33, 50.36, 200/50.32, 50.37
See application file for complete search history.

(56) References Cited

U.S. PATENT DOCUMENTS 3,579,706 A * 5/1971 Hetland ..... A47L 9/2842 15/327.1
3,678,288 A * 7/1972 Swanke ..... G05G 1/02 200/5 A
4,070,586 A * 1/1978 Breslin ..... A47L 9/2831 307/22
4,099,291 A * 7/1978 Bowerman ..... A47L 5/30 15/390
4,654,924 A * 4/1987 Getz ..... A47L 9/0411 15/319
4,733,431 A * 3/1988 Martin ..... A47L 9/1427 116/268
4,817,234 A * 4/1989 Greulich ..... A47L 9/2805 15/339
4,861,948 A * 8/1989 Fogleman, Sr. ..... H01H 15/102 200/1 A
4,905,343 A * 3/1990 Jailor ..... A47L 9/2842 15/328
4,958,406 A * 9/1990 Toyoshima ..... A47L 9/2821 15/319
4,987,637 A * 1/1991 Zummer ..... A47L 5/362 15/328
5,507,067 A * 4/1996 Hoekstra ..... A47L 9/281 15/319
5,735,959 A * 4/1998 Kubo ..... A47L 11/03 118/244
6,351,872 B1 * 3/2002 McCormick ..... A47L 5/30 15/334
6,631,535 B2 * 10/2003 Sergyeyenko ..... A47L 5/24 15/339
7,251,858 B2 * 8/2007 Hitzelberger ..... A47L 9/0488 15/377
7,316,051 B2 * 1/2008 Budd ..... A47L 5/34 15/319
7,392,566 B2 * 7/2008 Gordon ..... A47L 5/30 15/319
2004/0000023 A1 * 1/2004 Hitzelberger ..... A47L 5/30 15/389
2004/0221415 A1 * 11/2004 Tondra ..... A47L 9/2805 15/320
2007/0101536 A1 * 5/2007 Nielsen ..... A47L 5/28 15/351
2008/0201897 A1 * 8/2008 Nakai ..... A47L 9/0477 15/339
2008/0301900 A1 * 12/2008 Choi ..... A47L 9/2842 15/319
2009/0271944 A1 * 11/2009 Lovelass ..... A47L 5/30 15/383
2010/0186190 A1 * 7/2010 Genn ..... A47L 5/30 15/412

* cited by examiner

B

C

D

SWITCHING MECHANISM FOR A VACUUM CLEANER HAVING COUPLING MECHANISM FOR SWITCHING A VACUUM SWITCH AND AN AGITATOR SWITCH

This application claims the priority of United Kingdom Application No. 1219283.7, filed 26 Oct. 2012, the entire contents of which are incorporated herein by reference.

FIELD OF THE INVENTION

This invention relates to a switching mechanism for a vacuum cleaner having a vacuum generator and an agitator.

BACKGROUND OF THE INVENTION

Vacuum cleaners, for example domestic vacuum cleaners, typically comprise a main body, a vacuum generator for drawing an airflow into the main body and a cleaner head, or a floor tool attached to a hose, through which dirty air is drawn.

In order to assist cleaning, the cleaner head or floor tool is often provided with an agitator, such as a motor-driven brush bar or rotary heads. The agitator dislodges dirt from a surface to be cleaned, for example from between the fibres of carpets, so that the dirt can be more readily entrained by the airflow into the main body of the vacuum cleaner.

When the vacuum cleaner is used to clean delicate surfaces, for example polished wooden or tiled surfaces, or delicate fabrics, the agitator can scour and damage the surface, which is undesirable.

In order to solve this problem, vacuum cleaners are often provided with an agitator switch which allows the agitator to be turned off independently of the vacuum generator.

However, it has been found that, if the agitator has been turned off, a user will often forget to turn the agitator back on again when next operating the vacuum cleaner. A user will therefore often use the vacuum cleaner to clean carpets with the agitator being unknowingly switched off.

Known vacuum cleaners couple the agitator switch with the vacuum generator switch so that actuation of the vacuum generator automatically actuates the agitator. The agitator is then turned off each time by the user if not required. This ensures that the user cannot forget to turn the agitator on when using the vacuum cleaner.

In order to allow the agitator to be switched off independently of the vacuum generator, and to ensure correct sequencing resumes when the vacuum cleaner is switched off and on regardless of the whether the agitator has been turned off or on, switching of the agitator and the vacuum generator must be coupled or uncoupled accordingly.

A known switching mechanism is configured so that when both an agitator switch and a vacuum generator switch are open (i.e. the agitator and the vacuum generator are switched off), both switches are coupled together. Closing the vacuum generator switch therefore automatically closes the agitator switch. The switching mechanism is further configured such that the agitator switch is decoupled from the vacuum generator switch by closing the vacuum generator switch. The vacuum generator switch and the agitator switch can then be operated independently of each other.

In addition, each time the agitator switch is opened (i.e. the agitator is turned off), the agitator switch is re-coupled with the vacuum generator switch. This ensures that subsequent closing of the vacuum generator switch causes the agitator to be switched on with the vacuum generator switch. Consequently, in all cases, the agitator switch is coupled with the vacuum generator switch prior to turning the vacuum generator on. This ensures that the user cannot forget to turn the agitator on when using the vacuum cleaner.

A problem associated with the known switching mechanism is that coupling of the agitator switch with the vacuum generator switch whilst the vacuum generator switch is closed (i.e. the vacuum generator is on) causes the agitator to be activated briefly as the vacuum cleaner is switched off. Although the vacuum generator switch also acts as a master switch which turns the agitator off, the user, who until this point has been operating the vacuum cleaner with the agitator turned off, can find the brief activation of the agitator disconcerting.

SUMMARY OF THE INVENTION

According to a first aspect of the present invention there is provided a switching mechanism for a vacuum cleaner having a vacuum generator and an agitator, comprising a vacuum generator switch having an open state and a closed state, an agitator switch having an open state and a closed state, and a coupler for coupling the agitator switch with the vacuum generator switch such that switching of the vacuum generator switch between its open state and its closed state switches the agitator switch between its open state and its closed state, the switching mechanism being configured such that, switching of at least one of the agitator switch and the vacuum generator switch between its open state and its closed state uncouples the agitator switch from the vacuum generator switch, wherein the switching mechanism is further configured such that, when the vacuum generator switch and the agitator switch are uncoupled from each other and the agitator switch is in its open state, switching of the vacuum generator switch from its closed state to its open state couples the agitator switch with the vacuum generator switch.

An advantage of a switching mechanism in accordance with the first aspect of the invention is: when the agitator switch has been opened to switch an agitator off during use of a vacuum cleaner, opening of the vacuum generator switch to switch a vacuum generator off couples the agitator switch with the vacuum generator switch so that when the vacuum generator is next switched on, the agitator is also switched on automatically. Therefore, a user cannot forget to turn the agitator on.

In addition, a switching mechanism in accordance with the first aspect of the present invention provides the advantage that agitator switch is coupled with the vacuum generator switch by switching the vacuum generator switch from its closed state to its open state. Therefore, the agitator is not switched on as the vacuum generator is switched off, which overcomes the problem associated with the prior art.

In the present specification, unless the context requires otherwise, the agitator switch and the vacuum generator switch are coupled when the switching mechanism is in a state in which switching of the vacuum generator switch between an open state and a closed state would cause the agitator switch to switch between its open state and its closed state. The switches do not need to be in contact or connected to each other directly or via the coupler provided that switching of the vacuum generator switch would cause switching of the agitator switch. Furthermore, it will be appreciated that the agitator switch and the vacuum generator switch may be coupled such that switching of the agitator switch between its open state and its closed state does not switch the vacuum generator switch between its open state and its closed state.

The switching mechanism may be further configured such that, when the vacuum generator switch and the agitator switch are coupled with each other in their closed states, switching of the agitator switch from its closed state to its open state decouples the agitator switch from the vacuum generator switch. An advantage of this feature is that the agitator switch is decoupled from the vacuum generator switch when the agitator is switched off so that subsequent opening of the vacuum generator switch to switch the vacuum generator off does not switch the agitator on.

According to a second aspect of the invention there is provided switching mechanism for a vacuum cleaner having a vacuum generator and an agitator, comprising a vacuum generator switch having an open state and a closed state, an agitator switch having an open state and a closed state, a coupler for coupling the agitator switch with the vacuum generator switch such that switching of the vacuum generator switch between its open state and its closed state switches the agitator switch between its open state and its closed state, wherein the switching mechanism is configured such that, when the vacuum generator switch and the agitator switch are coupled with each other in their closed states, switching of the agitator switch from its closed state to its open state decouples the agitator switch from the vacuum generator switch.

An advantage of a switching mechanism in accordance with the second aspect of the invention is: when the agitator switch has been opened to switch the agitator off during use of a vacuum cleaner, opening of the vacuum generator switch to switch the vacuum generator off does not switch the agitator on.

The switching mechanism may be configured such that, when the vacuum generator switch and the agitator switch are coupled with each other in their open states, switching of the agitator switch from its open state to its closed state decouples the agitator switch from the vacuum generator switch. An advantage of this feature is that subsequent closing of the vacuum generator switch to switch the vacuum generator on does not switch the agitator off.

The switching mechanism may be further configured such that, when the vacuum generator switch and the agitator switch are uncoupled from each other, and the agitator switch is in its closed state, switching of the vacuum generator switch from its open state to its closed state couples the agitator switch with the vacuum generator switch. An advantage of this feature is that subsequent opening of the vacuum generator switch to switch the vacuum generator off also switches the agitator off. The feature therefore provides redundancy when the vacuum generator switch is also a master switch, or, if the vacuum generator switch is not also a master switch, provides a switching mechanism configured to switch the agitator off when the vacuum generator is switched off.

The switching mechanism may be further configured such that, when the vacuum generator switch and the agitator switch are uncoupled from each other, and the agitator switch is in its open state, switching of the agitator switch from its open state to its closed state couples the agitator switch with the vacuum generator switch. An advantage of this feature is that subsequent opening of the vacuum generator switch to switch the vacuum generator off also switches the agitator off. The feature therefore provides redundancy when the vacuum generator switch is also a master switch, or, if the vacuum generator switch is not also a master switch, provides a switching mechanism configured to switch the agitator off when the vacuum generator is switched off.

The vacuum generator switch may comprise a first switching member having an open state and a closed state and a first actuator having a passive position and at least one active position, the first actuator being arranged such that displacement of the first actuator between its passive position and its active position switches the first switching member between its open state and its closed state. An advantage of this feature is that the first actuator can be configured to be actuated by a user in accordance with user requirements rather than being constrained by the configuration of the first switching member.

The agitator switch may comprise a second switching member having an open state and a closed state and a second actuator having a passive position and an active position, the second actuator being arranged such that displacement of the second actuator between its passive position and its active position switches the second switching member between its open state and its closed state. An advantage of this feature is that the second actuator can be configured to be actuated by a user in accordance with user requirements rather than being constrained by the configuration of the second switching member.

The coupler may comprise a coupling member; the coupling member being operatively connected to the second actuator and the first switching member such that displacement of the second actuator with respect to the first switching member moves the coupling member between a coupled position in which the coupling member couples the first actuator with the second actuator and a first uncoupled position in which the coupling member does not couple the first actuator with the second actuator. An advantage of this feature is that coupling of the agitator switch with the vacuum generator switch is dependent on the relative position of the second actuator with respect to the first switching member and so each switch can be coupled or uncoupled with the other switch in both its open state and its closed state depending on the state of the other switch.

The first actuator and/or second actuator may be elongate and the, or each, actuator may be constrained to move substantially in its longitudinal direction. An advantage of this feature is that each of the first and second actuators can be readily actuated by a user.

The coupling member may be connected to the second actuator and the first switching member such that, when the first switching member is in its closed state, and the second actuator is in its active position, the coupling member is in the first uncoupled position, wherein switching of the first switching member from its closed state to its open state moves the coupler from the uncoupled position to the coupled position. An advantage of this feature is that opening of the first switching member couples the agitator switch with the vacuum generator switch.

The coupling member may be connected to the second actuator and the first switching member such that, when the first switching member is in its closed state and the second actuator is in its active position, the coupling member is in the coupled position, wherein displacement of the second actuator from its active position to its passive position moves the coupling member from the coupled position to the first uncoupled position. An advantage of this feature is that displacement of the second actuator from its active position to its passive position uncouples the agitator switch from the vacuum generator switch.

The coupling member may be connected to the second actuator and the first switching member such that, when the first switching member is in its open state and the second actuator is in its passive position, the coupling member is in the coupled position, wherein displacement of the second actuator from its passive position to its active position moves the coupling member from the coupled position to a second uncoupled position. An advantage of this feature is that displacement of the second actuator from its passive position to its active position uncouples the agitator switch from the vacuum generator switch.

The coupling member may be connected to the second actuator and the first switching member such that, when the first switching member is in its open state and the second actuator is in its active position, the coupling member is in the second uncoupled position, wherein switching of the first switching member from its open state to its closed state moves the coupling member form the second uncoupled position to the coupled position. An advantage of this feature is that switching of the first switching member from its open state to its closed state couples the agitator switch with the vacuum generator switch.

The coupling member may be pivotally connected to the second actuator such that the coupling member is rotatable by displacement of the second actuator with respect to the first switching member between the coupled position and the first uncoupled position. An advantage of this feature is that the coupling member may be readily operated in a confined space.

The coupling member may be rotatable by displacement of the second actuator with respect to the first switching member between the coupled position and the first and second uncoupled positions. An advantage of this feature is that the coupling member can be rotated by displacement of the second actuator or switching of the first switching member.

The coupling member may comprise a lever portion actuated by the first switching member and an engaging portion which engages with the first actuator, the engaging portion being movable by actuation of the lever portion between a coupled position in which the engaging portion engages with the first actuator and at least a first uncoupled position in which it does not. The lever portion and the engaging portion may be elongate and may extend perpendicularly with respect to each other.

The switching mechanism may further comprise a bias arranged to bias the first actuator towards its passive position. An advantage of this feature is that the first actuator can be returned automatically to its passive position when released by a user. The bias may be a resilient member such as a spring, for example a compression spring.

The bias may be disposed between the pressing member and the coupling member such that the coupling member, or at least a portion of the coupling member, is biased against the first switching member. For example, the lever portion may be biased against the first switching member. An advantage of this feature is that the coupling member is held in position against the first switching member by the bias.

The vacuum generator switch and the agitator switch may be connected to a power supply for supplying power to a vacuum generator and an agitator. The vacuum generator switch may be a master switch which, when in its open state, disconnects the agitator switch from the power supply. An advantage of the generator switch being a master switch is that the agitator of a vacuum cleaner comprising the switching mechanism is switched off automatically when the vacuum generator is switched off.

According to a third aspect of the present invention there is provided a vacuum cleaner comprising a vacuum generator, an agitator and a switching mechanism in accordance with any one of the preceding claims.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
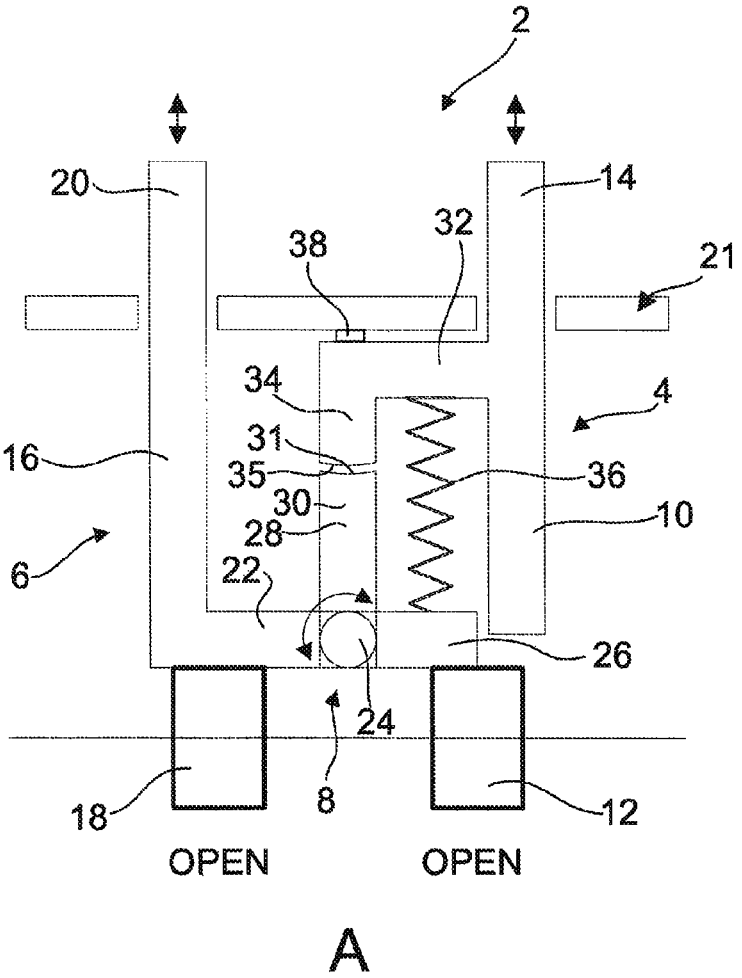
FIG. 1 is a schematic representation of a switching mechanism in a first configuration.

FIG. 1 is a schematic representation of a switching mechanism 2 for a vacuum cleaner. The switching mechanism 2 comprises a vacuum generator switch 4, an agitator switch 6 and a coupler 8 for coupling and uncoupling the agitator switch 6 with the vacuum generator switch 4.

The vacuum generator switch 4 comprises a first actuator 10, in the form of an elongate pressing member, and a first switching member 12. A lower end of the first actuator 10 opposes the first switching member 12. The lower end of the first actuator 10 is arranged so that it can be brought into abutting engagement with the first switching member 12 by downward displacement of the first actuator 10. The upper end of the first actuator 10 forms a button 14 for actuation by a user.

The agitator switch 6 comprises a second actuator 16, in the form of an elongate pressing member, and a second switching member 18. A lower end of the second actuator 16 abuts the second switching member 18 and an upper end forms a button 20 for actuation by a user.

Each of the first switching member 12 and the second switching member 18 has a depressed closed state and a raised open state. Each switching member 12, 18 comprises a bias (not shown), for example a resilient member such as a spring, which biases the switching member 12, 18 into its raised open state, and a latching mechanism (not shown) which latches the switching member 12, 18 in its depressed closed state. Pressing the switching member 12, 18 from the raised open state into the depressed closed state causes the latching mechanism to latch the switching member 12, 18 in the depressed closed state. Pressing the switching member 12, 18 when in the depressed closed state unlatches the latching mechanism such that the switching member 12, 18 is returned by the bias into the raised open state when the switching member 12, 18 is released.

Figure 8:
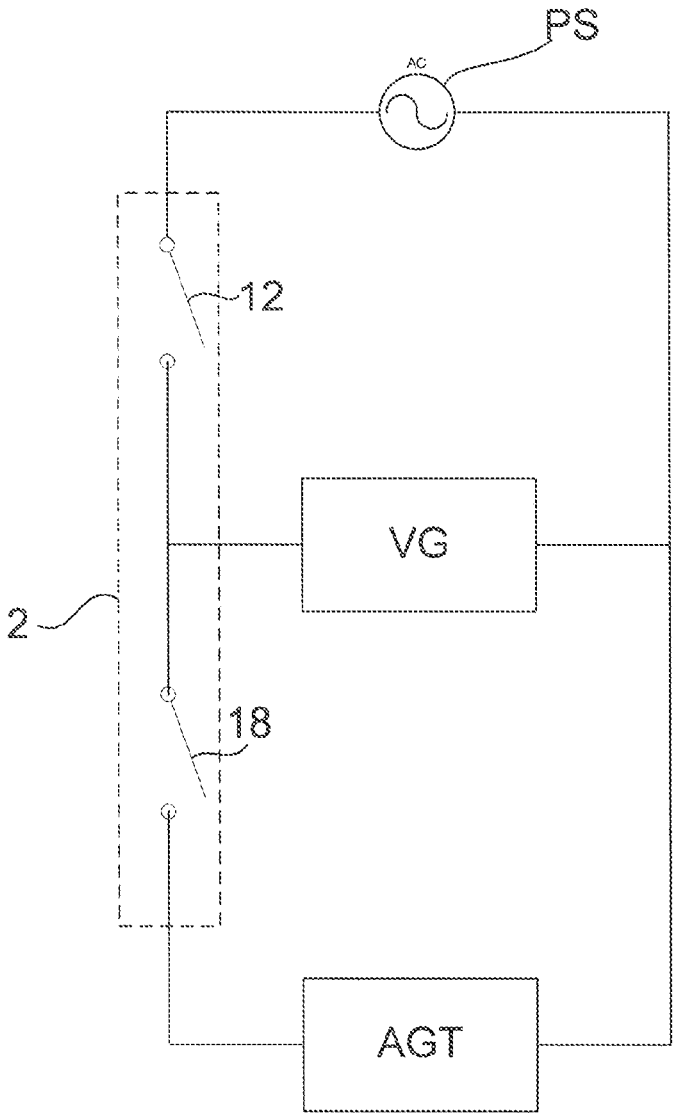
FIG. 8 is a circuit diagram showing the arrangement of the switching mechanism shown in FIG. 1 in a switch circuit.

As shown in FIG. 8, the first switching member 12 connects a power supply (PS) with a vacuum generator (VG) when in the depressed closed state, and disconnects the power supply (PS) from the vacuum generator (VG) when in the raised open state.

Similarly, the second switching member 18 connects a power supply (PS) with an agitator (AGT) when in the depressed closed state, and disconnects the power supply (PS) from the agitator (AGT) when in the raised open state.

The first switching member 12 is also arranged as a master switch which, when open, disconnects the power supply (PS) from the agitator (AGT) by overriding the second switching member 18.

Referring to FIG. 1, both the first actuator 10 and the second actuator 16 are constrained to move in their respective longitudinal directions only by a guide member 21. The guide member 21 may, for example, be a wall of a housing for the switching mechanism 2.

The second actuator 16 comprises a mounting arm 22 at the lower end of the actuator 16 which extends laterally with respect to the length of the second actuator 16, and towards the first actuator 10. The coupler 8 comprises a coupling member 24 which is pivotally mounted to the mounting arm 22 at the distal end of the mounting arm 22. The coupling member 24 comprises a lever arm 26 and a locking arm 28 which extend perpendicularly to each other. The coupling member 24 is mounted to the mounting arm 22 at the intersection of the lever arm 26 and the locking arm 28.

The locking arm 28 extends upwardly from the pivotal connection and substantially parallel with the longitudinal direction of the second actuator 16. The locking arm 28 is provided with a first engaging feature 30 which, in the embodiment shown, comprises a concave upper surface 31 provided at the distal end of the locking arm 28.

The lever arm 26 extends from the pivotal connection towards the first actuator 10, and rests on the first switching member 12. In the embodiment shown, the distal end of the lever arm 26 is in abutting engagement with an upper surface of the first switching member 12.

The coupling member 24 is rotatable with respect to the mounting arm 22 in a plane which is substantially parallel with the longitudinal direction of the second actuator 16, and which extends substantially in the direction from the second actuator 16 towards the first actuator 10.

The first actuator 10 comprises a coupling arm 32 which extends laterally with respect to the length of the first actuator 10, and substantially towards the second actuator 16.

The coupling arm 32 is provided with a second engaging feature 34 which corresponds to the first engaging feature 30 of the coupling member 24. In the embodiment shown, the second engaging feature 34 comprises a downwardly extending projection having a convex lower surface 35. As shown in FIG. 1, the concave upper surface 31 and the convex lower surface 35 oppose each other.

A bias in the form of a compression spring 36 is disposed between the first actuator 10 and the lever arm 26. The spring 36 is arranged such that the spring 36 urges the lever arm 26 downwardly away from the first actuator 10 and into pressing engagement with the first switching member 12. The first actuator 10 is also urged upwardly away from the lever arm 26 and the first switching member 12 towards a restraint 38 by the spring 36. The restraint 38 prevents excessive displacement of the first actuator 10 away from the first switching member 12.

Figure 2:
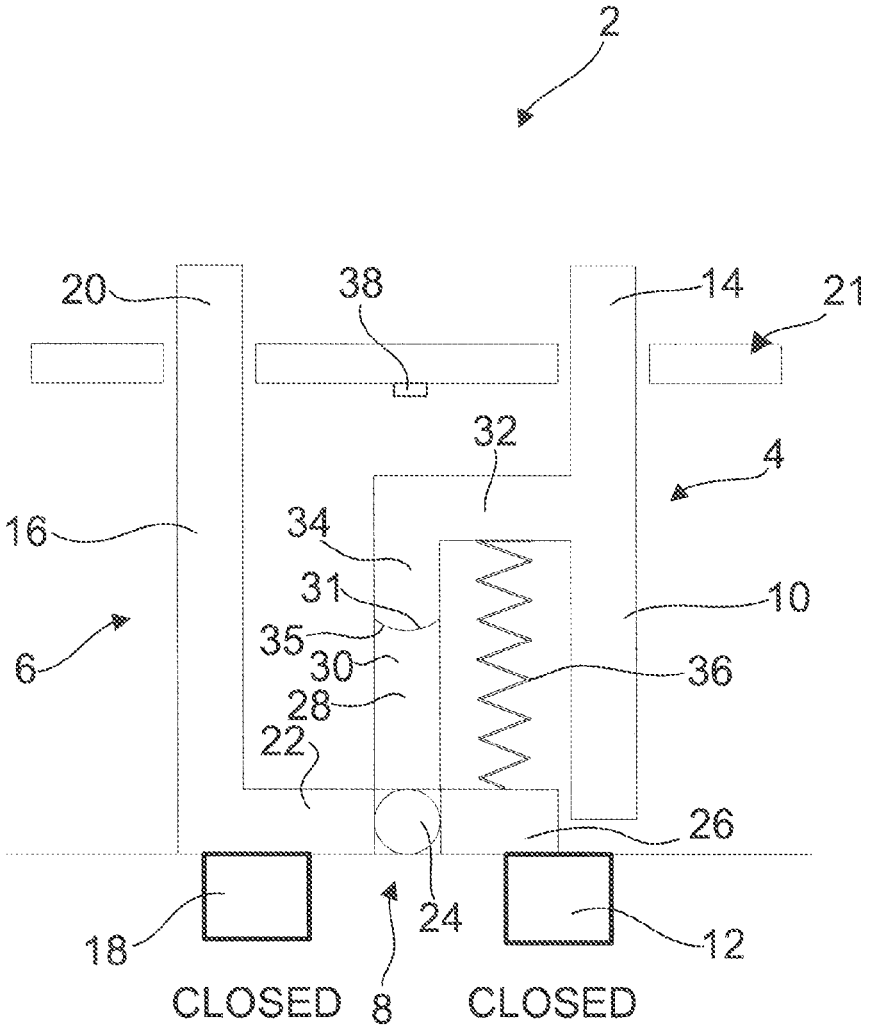
FIG. 2 is a schematic representation of the switching mechanism shown in FIG. 1 in a transitory configuration.
Figure 5:
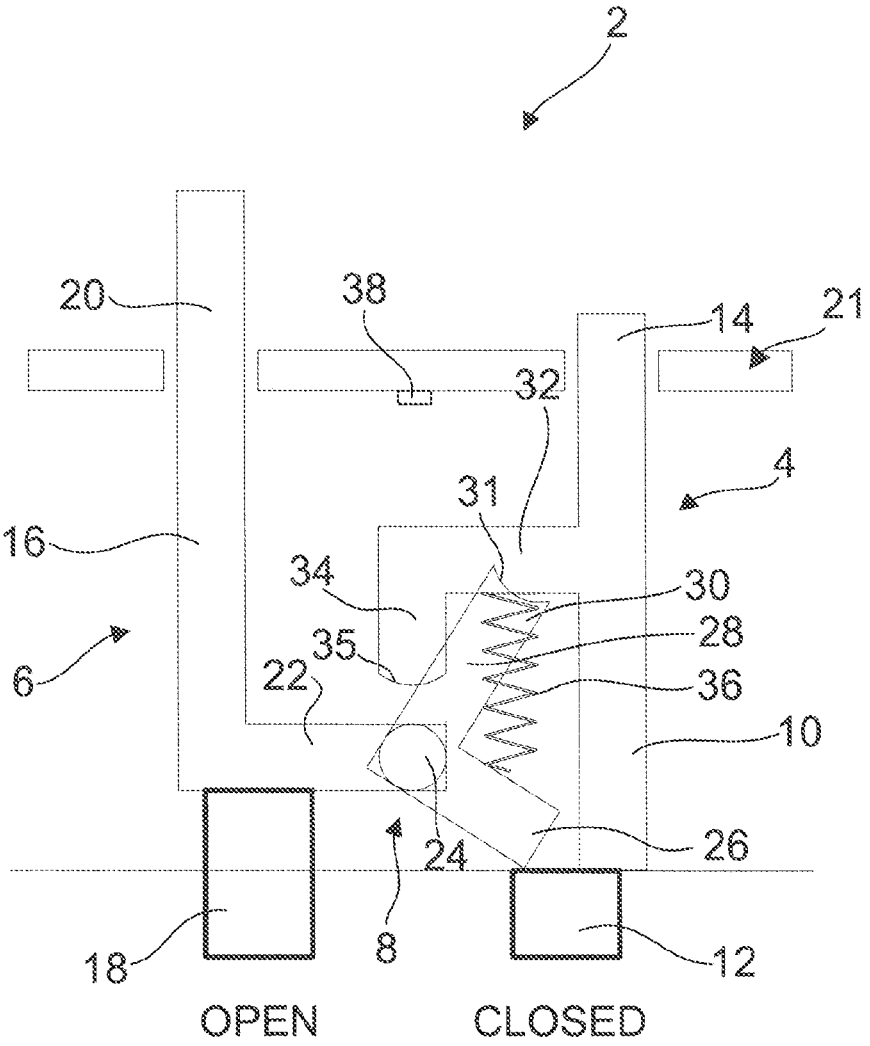
FIG. 5 is a schematic representation of the switching mechanism shown in FIG. 1 in a second transitory configuration.

The first actuator 10 has a passive position in which the first actuator 10 abuts the restraint 38, and first and second active positions in which the first actuator 10 is disposed away from the restraint 38. In the first active position, the first actuator 10 presses against the coupling member 24 which, in turn, presses against the first switching member 12, as shown in FIG. 2. In the second active position, the lower end of the first actuator 10 presses directly against the first switching member 12, as shown in FIG. 5.

The second actuator 16 is arranged to move in unison with the second switching member 18. The second actuator 16 has a passive position which corresponds to the position of the second actuator 16 when the second switching member 18 is in its open state, and an active position which corresponds to the position of the second actuator 16 when the second switching member 18 is in its closed state. It will be appreciated that the second switching member 18 and the second actuator 16 may be formed integrally.

Figure 6:
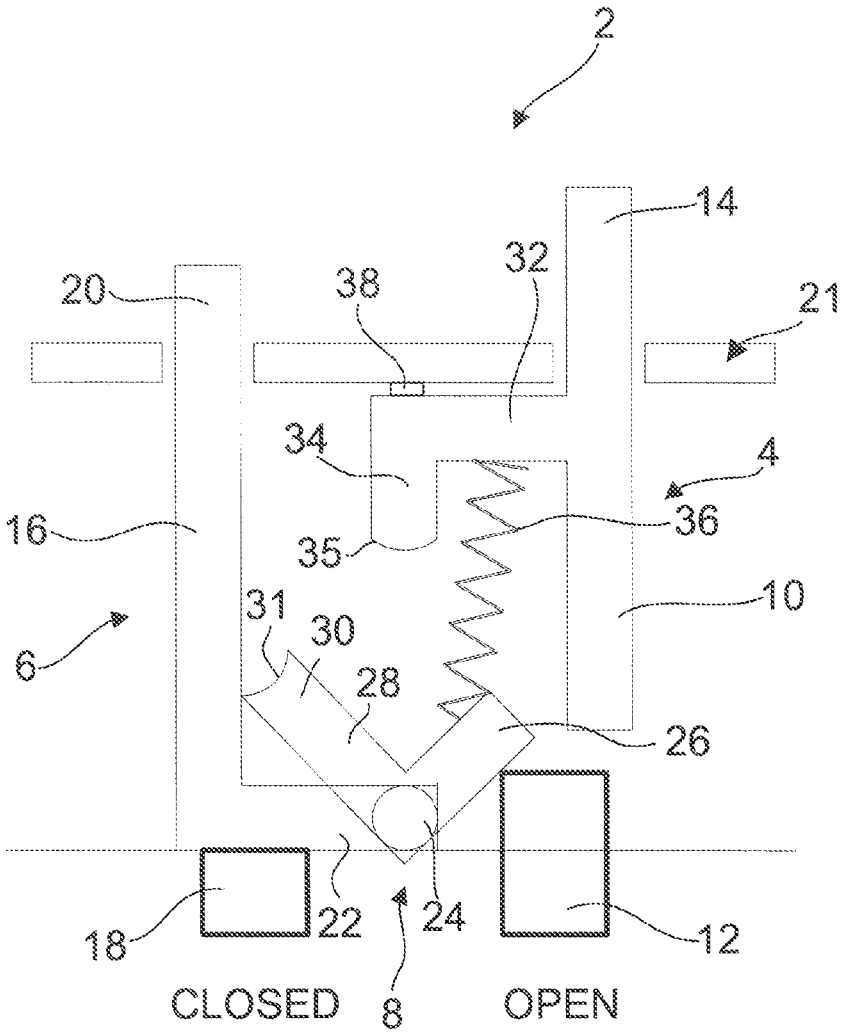
FIG. 6 is a schematic representation of the switching mechanism shown in FIG. 1 in a fourth configuration.
Figure 7:
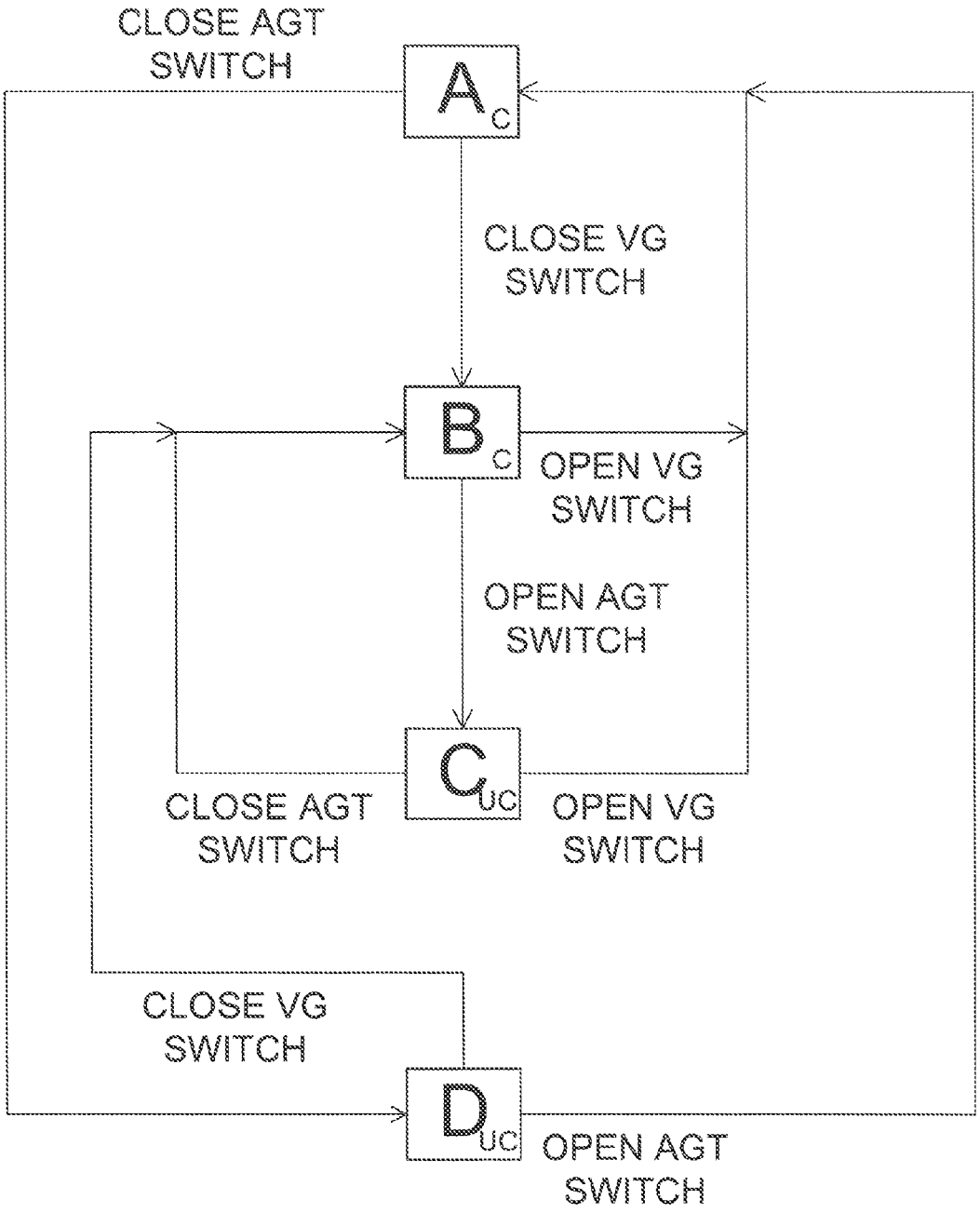
FIG. 7 is a flow chart illustrating a switching sequence of the switching mechanism shown in FIGS. 1 to 6.

The switching sequence of the switching mechanism 2 will now be described with reference to FIGS. 1 to 6, which show the switching mechanism in different switching configurations, and with reference to FIG. 7, which shows a flow chart of the switching sequence.

FIG. 1 shows the switching mechanism 2 in a first configuration (Configuration A) in which the agitator switch 6 is coupled with the vacuum generator switch 4. Configuration A corresponds to the situation in which a vacuum cleaner comprising the switching mechanism 2 is not in use; the vacuum generator and the agitator being switched off.

The first switching member 12 and the second switching member 18 are both in their raised open states, and the first actuator 10 and the second actuator 16 are in their passive positions. The coupling member 24 is oriented with the locking arm 28 extending substantially upwardly, and the lever arm 26 extending horizontally. The first engaging feature 30 of the locking arm 28 is aligned with the second engaging feature 34 of the first actuator 10 such that the concave upper surface 31 and the convex lower surface 35 of the first and second engaging features 30, 34 oppose each other.

Pressing of the first actuator 10 displaces the first actuator 10 downwardly into its first active position, as shown in FIG. 2. The upper and lower surfaces 31, 35 of the engaging features 30, 34 are brought into abutting engagement with each other so that the coupling arm 32 of the first actuator 10 presses downwardly on the locking arm 28 of the coupling member 24 thereby causing the second actuator 16 to move downwardly with the first actuator 10. Pressing of the second actuator 16 against the second switching member 18 switches the second switching member 18 from its open state to its closed state. At the same time, the lever arm 26 is presses downwardly on the first switching member 12. The interlocking engagement of the first and second engaging features 30, 34 prevent the reaction force of the first switching member 12 from rotating the coupling member 24 in an anticlockwise direction (as viewed in FIG. 2). Therefore, the lever arm 26 presses the first switching member 12 from its raised open state to its depressed closed state.

The first and second switching members 12, 18 latch in their depressed closed states.

Figure 3:
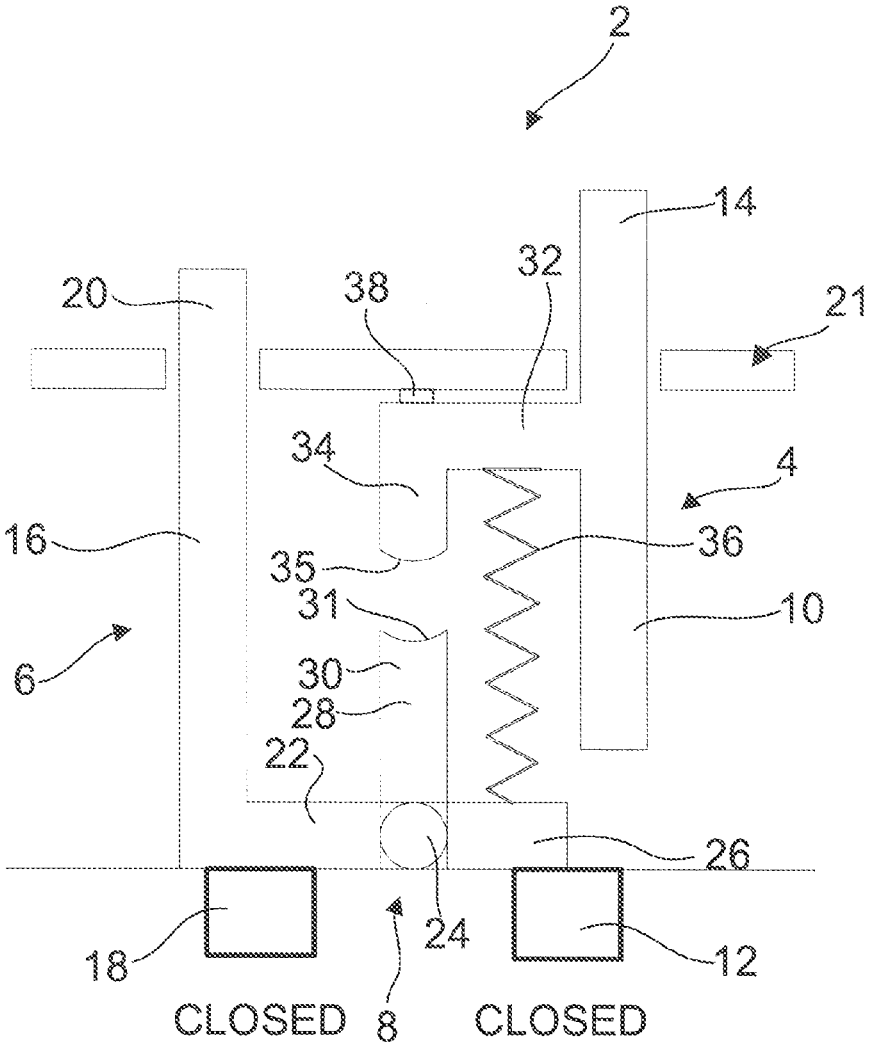
FIG. 3 is a schematic representation of the switching mechanism shown in FIG. 1 in a second configuration.

On release of the first actuator 10, the spring 36 urges the first actuator 10 away from the first switching member 12 into its passive position, as shown in FIG. 3. The second engaging feature 34 separates from the first engaging feature 30. The spring 36 continues to press the lever arm 24 against the first switching member 12.

It will be appreciated that in the configuration shown in FIG. 3, the agitator switch 6 remains coupled with the vacuum generator switch 4.

If the first actuator 10 is pressed subsequently, the engaging features 30, 34 re-engage so that the first actuator 10 actuates the second actuator 16 as the first actuator 10 moves downwardly. Consequently, the first actuator 10 and the second actuator 16 press the respective first and second switching members 12, 18 simultaneously, thereby releasing the latching mechanisms of the switching members 12, 18.

On release of the first actuator 10, the second switching member 18 is returned to its raised open state by its bias, thereby returning the second actuator 16 to its passive position. At the same time, the first switching member 12 is returned to its raised open state by its bias, and the first actuator 10 is returned to its passive position by the spring 36. The switching mechanism 2 is therefore returned to Configuration A, as shown in FIG. 1.

Alternatively, if, when in Configuration B shown in FIG. 3, the user decides to switch the agitator off (prior to cleaning delicate surfaces, for example), the user presses the second actuator 16 against the second switching member 18 which releases the latching mechanism of the second switching member 18. On release of the second actuator 16, the bias of the second switching member 18 returns the second switching member 18 to its raised open state, thereby switching the agitator off. At the same time, the second switching member 18 returns the second actuator 16 to its passive position, as shown in FIG. 4 (Configuration C).

As the second actuator 16 moves upwardly, the lever arm 26 is held against the first switching member 12 by the spring 36. Consequently, the upward motion of the second actuator 16 and the mounting arm 22 to which the coupling member 24 is attached causes the coupling member 24 to rotate clockwise (as viewed in FIG. 4). The first engaging feature 30 of the locking arm 28 is therefore moved out of alignment with the second engaging feature 34 of the coupling arm 32.

Figure 4:
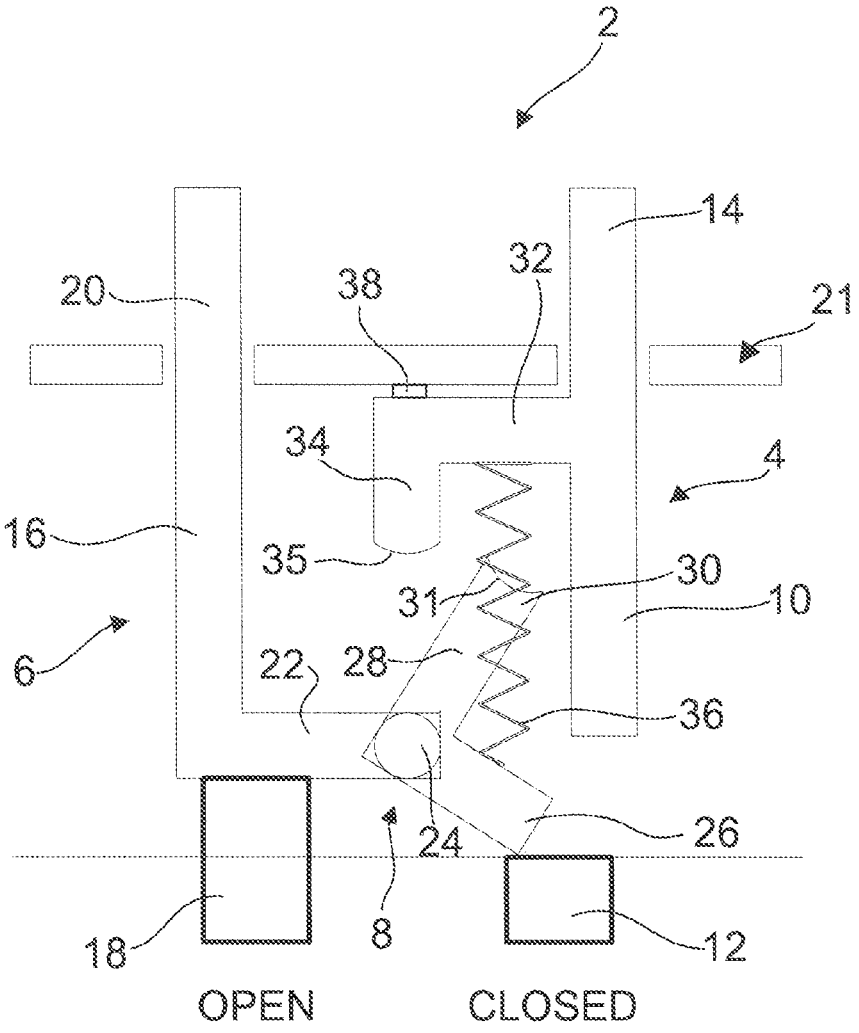
FIG. 4 is a schematic representation of the switching mechanism shown in FIG. 1 in a third configuration.

In the configuration shown in FIG. 4, the agitator switch 6 is uncoupled from the vacuum generator switch 4.

If the user turns the agitator back on again by pressing the second actuator 16, the coupling member 24 rotates in the anticlockwise direction back into Configuration B (see FIG. 3) thereby re-coupling the agitator switch 6 with the vacuum generator switch 4.

Alternatively, if, when in Configuration C (see FIG. 4), the user switches the vacuum generator off by pressing the first actuator 10, the second engaging feature 34 moves downwardly alongside the locking arm 28 as the first actuator 10 moves from its passive configuration into its second active configuration, as shown in FIG. 5.

Therefore, the engaging features 30, 34 do not engage with each other and so actuation of the first actuator 10 does not cause actuation of the second actuator 16. As the first actuator 10 reaches its second active position it presses against the first switching member 12 thereby releasing the latching mechanism.

On release of the first actuator 10, the bias of the first switching member 12 returns the first switching member 12 to its raised open state thereby rotating the coupling member 24 anticlockwise. At the same time, the spring 36 drives the first actuator 10 upwardly into its passive position. This brings the engaging features 30, 34 into alignment with each other. The switching mechanism 2 therefore returns to the configuration shown in FIG. 1 (Configuration A) in which the agitator switch 6 is coupled with the vacuum generator switch 4.

Consequently, the switching mechanism 2 is arranged such that, when the vacuum generator is next switched on, the agitator is also switched on simultaneously (as described above).

An alternative scenario is that, starting from Configuration A shown in FIG. 1, the user decides to turn the agitator on before turning the vacuum generator on.

The user therefore presses the second actuator 16 against the second switching member 18 thereby switching the second switching member 18 into its depressed closed state. The coupling member 24 is drawn downwardly with the second actuator 16 away from the coupling arm 32 of the first actuator 10. The second actuator 16 is therefore displaced from its passive position to its active position independently of the first actuator 10 which remains in its passive position abutting the restraint 38.

The distal end of the lever arm 26 rests against the raised first switching member 12. Therefore, lowering of the pivotal connection of the coupling member 24 with respect to the end of the lever arm 26 causes the coupling member 24 to rotate anticlockwise. The first engaging feature 30 of the locking arm 28 is therefore displaced out of alignment with the second engaging feature 34 of the coupling arm 32, as shown in FIG. 6 (Configuration D). FIG. 6 shows the coupling member 24 in a second uncoupled position in which the agitator switch 6 is uncoupled from the vacuum generator switch 4.

When the user presses the first actuator 10 to switch the vacuum generator on, the second engaging feature 34 moves downwardly alongside the locking arm 28. Therefore, the engaging features 30, 34 do not engage with each other and so actuation of the first actuator 10 from its passive position to its second active position does not cause actuation of the second actuator 16. The lower end of the first actuator 10 is brought into pressing engagement with the first switching member 12 to switch the first pressing member 12 from its raised open state into its depressed closed state. Therefore, the vacuum generator is switched on without switching the agitator off.

In addition, as the first actuator 10 presses the first switching member 12 into the depressed closed state, the end of the lever arm 26 moves downwardly with the first switching member 12. This causes the coupling member 24 to rotate clockwise. However, the coupling arm 32 and the second engaging feature 34 prevent the engaging features 30, 34 from being brought into alignment by obstructing rotation of the locking arm 28. As the first actuator 10 is released, the spring 36 holds the lever arm 26 against the first switching member 12 so that the engaging features 30, 34 are brought into alignment as the first actuator 10 returns to its passive position. The switching mechanism 2 is therefore in the configuration shown in FIG. 3 (Configuration B) in which the agitator switch 6 is coupled with the vacuum generator switch 4.

Alternatively, the agitator can be switched off again before the vacuum generator is turned on by pressing the second actuator 16 against the second switching member 18. The switching mechanism 2 therefore returns to the configuration shown in FIG. 1 (Configuration A).

The invention claimed is:

1. A switching mechanism for a vacuum cleaner having a vacuum generator and an agitator, comprising:

a vacuum generator switch having an open state and a closed state;

an agitator switch having an open state and a closed state; and a mechanical coupler for coupling the agitator switch with the vacuum generator switch such that switching of the vacuum generator switch between its open state and its closed state switches the agitator switch between its open state and its closed state, wherein the mechanical coupler comprises a coupling member that is moveable to a first uncoupled position and a second uncoupled position, and the switching mechanism being configured such that, switching of at least one of the agitator switch and the vacuum generator switch between its open state and its closed state uncouples the agitator switch from the vacuum generator switch, wherein the switching mechanism is further configured such that, when the vacuum generator switch and the agitator switch are uncoupled from each other and the agitator switch is in its open state, switching of the vacuum generator switch from its closed state to its open state couples the agitator switch with the vacuum generator switch.

2. The switching mechanism of claim 1, the switching mechanism being further configured such that, when the vacuum generator switch and the agitator switch are coupled with each other in their closed states, switching of the agitator switch from its closed state to its open state decouples the agitator switch from the vacuum generator switch.

3. A switching mechanism for a vacuum cleaner having a vacuum generator and an agitator, comprising:

a vacuum generator switch having an open state and a closed state;

an agitator switch having an open state and a closed state; and a mechanical coupler for coupling the agitator switch with the vacuum generator switch such that switching of the vacuum generator switch between its open state and its closed state switches the agitator switch between its open state and its closed state, wherein the mechanical coupler comprises a coupling member that is moveable to a first uncoupled position and a second uncoupled position, and wherein the switching mechanism is configured such that, when the vacuum generator switch and the agitator switch are coupled with each other in their closed states, switching of the agitator switch from its closed state to its open state decouples the agitator switch from the vacuum generator switch.

4. The switching mechanism of claim 1, the switching mechanism being configured such that, when the vacuum generator switch and the agitator switch are coupled with each other in their open states, switching of the agitator switch from its open state to its closed state decouples the agitator switch from the vacuum generator switch.

5. The switching mechanism of claim 1, the switching mechanism being further configured such that, when the vacuum generator switch and the agitator switch are uncoupled from each other, and the agitator switch is in its closed state, switching of the vacuum generator switch from its open state to its closed state couples the agitator switch with the vacuum generator switch.

6. The switching mechanism of claim 1, the switching mechanism being further configured such that, when the vacuum generator switch and the agitator switch are uncoupled from each other, and the agitator switch is in its open state, switching of the agitator switch from its open state to its closed state couples the agitator switch with the vacuum generator switch.

7. The switching mechanism of claim 1, wherein:

the vacuum generator switch comprises a first switching member having an open state and a closed state and a first actuator having a passive position and at least one active position, the first actuator being arranged such that displacement of the first actuator between its passive position and its active position switches the first switching member between its open state and its closed state;

the agitator switch comprises a second switching member having an open state and a closed state and a second actuator having a passive position and an active position, the second actuator being arranged such that displacement of the second actuator between its passive position and its active position switches the second switching member between its open state and its closed state; and the coupling member is operatively connected to the second actuator and the first switching member such that displacement of the second actuator with respect to the first switching member moves the coupling member between a coupled position in which the coupling member couples the first actuator with the second actuator and the first uncoupled position in which the coupling member does not couple the first actuator with the second actuator.

8. The switching mechanism of claim 7, the coupling member being connected such that, when the first switching member is in its closed state, and the second actuator is in its passive position, the coupling member is in the first uncoupled position, wherein switching of the first switching member from its closed state to its open state moves the coupling member from the uncoupled position to the coupled position.

9. The switching mechanism of claim 7, the coupling member being connected such that, when the first switching member is in its closed state and the second actuator is in its active position, the coupling member is in the coupled position, wherein displacement of the second actuator from its active position to its passive position moves the coupling member from the coupled position to the first uncoupled position.

10. The switching mechanism of claim 7, the coupling member being connected such that, when the first switching member is in its open state and the second actuator is in its passive position, the coupling member is in the coupled position, wherein displacement of the second actuator from its passive position to its active position moves the coupling member from the coupled position to the second uncoupled position.

11. The switching mechanism of claim 10, the coupling member being connected such that, when the first switching member is in its open state and the second actuator is in its active position, the coupling member is in the second uncoupled position, wherein switching of the first switching member from its open state to its closed state moves the coupling member form the second uncoupled position to the coupled position.

12. The switching mechanism of claim 7, wherein the coupling member is pivotally connected to the second actuator such that the coupling member is rotatable by displacement of the second actuator with respect to the first switching member between the coupled position and the first uncoupled position.

13. The switching mechanism of claim 7, the switching mechanism further comprising a bias arranged to bias the first actuator towards its passive position.

14. The switching mechanism of claim 13, wherein the bias is disposed between the first actuator and the coupling member such that the coupling member is biased against the first switching member.

15. The switching mechanism of claim 1, the vacuum generator switch and the agitator switch being connected to a power supply for supplying power to a vacuum generator and an agitator, wherein the vacuum generator switch is a master switch which, when in its open state, disconnects the agitator switch from the power supply.

16. A vacuum cleaner comprising a vacuum generator, an agitator and a switching mechanism, the switching mechanism comprising:

a vacuum generator switch having an open state and a closed state;

an agitator switch having an open state and a closed state; and a mechanical coupler for coupling the agitator switch with the vacuum generator switch such that switching of the vacuum generator switch between its open state and its closed state switches the agitator switch between its open state and its closed state, wherein the mechanical coupler comprises a coupling member that is moveable to a first uncoupled position and a second uncoupled position, and the switching mechanism being configured such that, switching of at least one of the agitator switch and the vacuum generator switch between its open state and its closed state uncouples the agitator switch from the vacuum generator switch, wherein the switching mechanism is further configured such that, when the vacuum generator switch and the agitator switch are uncoupled from each other and the agitator switch is in its open state, switching of the vacuum generator switch from its closed state to its open state couples the agitator switch with the vacuum generator switch.

* * * * *